US005375713A

United States Patent [19]

Horvat et al.

[11] Patent Number: 5,375,713

[45] Date of Patent: Dec. 27, 1994

[54] PACKED ELECTRIC LAMP OF TRIANGULAR PLANFORM

[75] Inventors: David W. Horvat, South Plainfield; Michael R. Day, Freehold, both of N.J.

[73] Assignee: Philips Electronics North America Corporation, New York, N.Y.

[21] Appl. No.: 164,229

[22] Filed: Dec. 8, 1993

[51] Int. Cl.[5] ..... B65D 85/42

[52] U.S. Cl. ..... 206/418; 229/115

[58] Field of Search ..... 229/115; 206/418

[56] References Cited

U.S. PATENT DOCUMENTS

| | | | |
|---|---|---|---|
| 1,653,914 | 12/1927 | Keppler | 229/115 X |
| 1,679,710 | 8/1928 | Creasey . | |
| 1,996,778 | 4/1935 | Wellman | 206/418 |
| 2,421,748 | 6/1947 | Fink | 229/6 |
| 3,295,740 | 1/1967 | Hall | 229/115 X |
| 3,638,848 | 2/1972 | Heyworth | 206/418 X |
| 4,018,335 | 4/1977 | Jacob et al. | 206/422 |
| 4,039,118 | 8/1977 | Kawaoka | 229/17 B |
| 4,131,198 | 12/1978 | Fischer | 206/419 |
| 4,682,726 | 7/1987 | Drueck, Jr. | 229/108 |
| 5,028,000 | 7/1991 | Chabot et al. | 229/143 |
| 5,125,565 | 6/1992 | Rogers | 229/115 |

FOREIGN PATENT DOCUMENTS

| | | | |
|---|---|---|---|
| 861668 | 1/1953 | Germany . | |
| 870677 | 3/1953 | Germany . | |
| 1541131 | 2/1990 | Russian Federation | 229/115 |
| 1555199 | 4/1990 | Russian Federation | 229/115 |
| 442132 | 1/1968 | Switzerland | 229/115 |
| 156442 | 7/1968 | Switzerland | 229/115 |

*Primary Examiner*—William I. Price

*Attorney, Agent, or Firm*—Brian J. Wieghaus

[57] ABSTRACT

A packed electric lamp including a carton having three articulated sides defining a sleeve of triangular cross-section with opposing open ends and two opposing triangular flaps closing the open ends of the triangular sleeve. A reflector lamp having a broad face and a tapered reflector body is arranged in the carton with its broad face extending along one of the three sides defining the triangular sleeve, the other two carton sides defining the triangular sleeve extending along the tapered body and terminating at a corner of the sleeve adjacent the distal end of the reflector body. The carton has a significantly smaller plan form than rectangular or square cuboidal cartons, allowing more lamps to fit in a given space on retail shelves. The carton is formed from a unitary blank having three rectangular panels joined at fold lines and first and second opposing primary triangular flaps articulated from respective ones of the rectangular panels. The corners of the opposing triangular sides may be truncated to further reduce the planform of the carton and lamp packed therein.

13 Claims, 6 Drawing Sheets

PACKED ELECTRIC LAMP OF TRIANGULAR PLANFORM

BACKGROUND OF THE INVENTION

1. Field of the Invention

The invention relates to packaging for light bulbs and, in particular, for reflector lamps such as sealed beam automotive headlamps and other similarly shaped articles which have a broad face and tapered body.

2. Description of the Prior Art

Automotive sealed beam headlamps are currently packaged in cartons of square or rectangular cuboidal shape, as illustrated in FIG. 1. The usual flaps and locking tabs are not illustrated for clarity. These headlamps have a broad face at the front lens 40, which is either of circular or rectangular shape. The lamps have a glass reflector 41 extending from the lens which is tapered, i.e. of continuously reducing cross section, due to the generally parabolic shape of the reflector. Lamp connection terminals 42 are provided at the distal end of the reflector, which is of substantially smaller cross-section than the lens at the front of the lamp. The lamps can be considered to have height and width dimensions corresponding to the short 43 and long 44 sides of the rectangular lens face and a depth dimension 45 extending from the front of the lens face to the rear of the connection terminals. The lamp is typically positioned in the carton with the lens 40 against a front panel 46 of the carton, which is generally of about the same size as the lens. The opposing, rear panel 47 is of identical size as the front panel. The panels 48,49,50,51 have one dimension which corresponds to the depth dimension 45 and an other dimension which corresponds to either the height 43 or width 44 of the lens.

This common, regular shape provides a carton which may be readily assembled, is packable in an outer shipping container in a regular arrangement, i.e. without empty spaces between adjacent cartons, and provides stable stacking on a retail shelf. The known cartons are very inefficient, however, with respect to paperboard usage, packing volume and plan-o-gram space utilization. Because of the irregular tapered shape of the headlamps, the volume enclosed by the carton is substantially greater than the volume enclosed by the headlamps. The planform, or footprint, of the package on the shelf, typically with the lens oriented normal to the shelf with its long side parallel thereto, is also larger than necessary. The latter is a significant disadvantage because suppliers of retail products typically must pay for shelf space at retail establishments. For a given size shelf, excess package volume and planform reduces the amount of products which can be displayed. Additionally, larger package volume typically increases shipping costs because it limits the number of products which can be packed in a standard shipping case shipped, for example, within a tractor-trailer truck.

SUMMARY OF THE INVENTION

Accordingly, it is an object of the invention to provide a carton for sealed beam headlamps and other articles of similar shape which is more efficient in terms of paperboard usage and volume utilization than the known cartons while maintaining the advantageous features of ease of assembly, stackability, and regular case packing. It is also an object of the invention to provide a unitary blank for forming the carton and a packed electric lamp having these advantageous features.

According to the invention, the above objects are accomplished in a packed electric lamp in which the carton includes three sides defining a sleeve of triangular cross-section and two opposing triangular sides closing the open ends of the sleeve. The lamp is arranged in the carton between the two opposing triangular sides with its broad face adjacent one of three sides defining the sleeve and with the other two of the three sides extending along the tapered body and terminating at a corner adjacent the lamp connection terminals. It has been found that a carton of this shape is about twice as efficient as the known cartons with respect to enclosed volume and planform for sealed-beam headlamps.

Preferably, the opposing triangular sides are parallel to each other to retain stackability when the cartons are stacked with their triangular sides face to face and parallel with a horizontal shelf. Additionally, it is favorable that the sleeve is cylindrical and that the opposing triangular sides and the cross-section of the sleeve have the shape of an isosceles right triangle. The cylindrical sleeve sides and the right angle between two of the cylinder sides facilitates packing of the packed lamps in a regular arrangement, i.e., without voids therebetween, in a standard cuboidal shipping case.

In a favorable embodiment of the invention, the carton is formed of a unitary blank including three rectangular panels articulated at first and second parallel fold lines. The opposing triangular sides are comprised by first and second primary triangular flaps each joined to a respective one of the rectangular side panels. Means for securing the carton together may include any combination of tabs, glue and/or locking tabs.

In another embodiment of the invention, each of the corners of the triangular carton sides are truncated to further reduce packed volume.

These and other objects, features, and advantages will become apparent with reference to the followings drawings, detailed description, and claims.

DESCRIPTION OF THE PREFERRED EMBODIMENTS

While the carton according to the present invention can be used to protectively package various kinds of articles having a broad face and tapered body, it is especially adapted for use with electric lamps and, in particular, with sealed-beam automotive headlamps and accordingly will be so illustrated and described.

Figure 2:
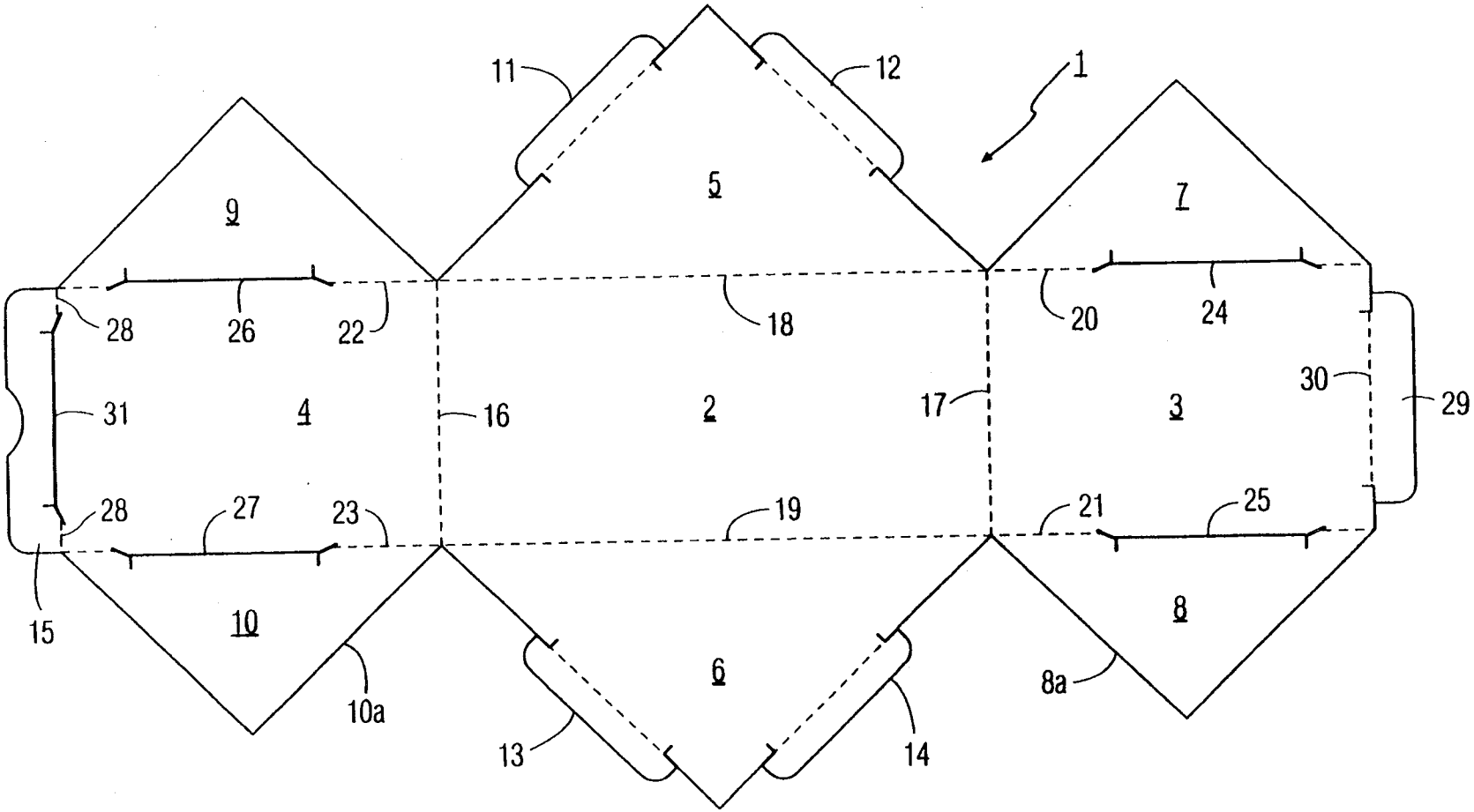
FIG. 2 shows a unitary blank according to the invention for a triangular carton for a sealed-beam lamp.
Figure 6:
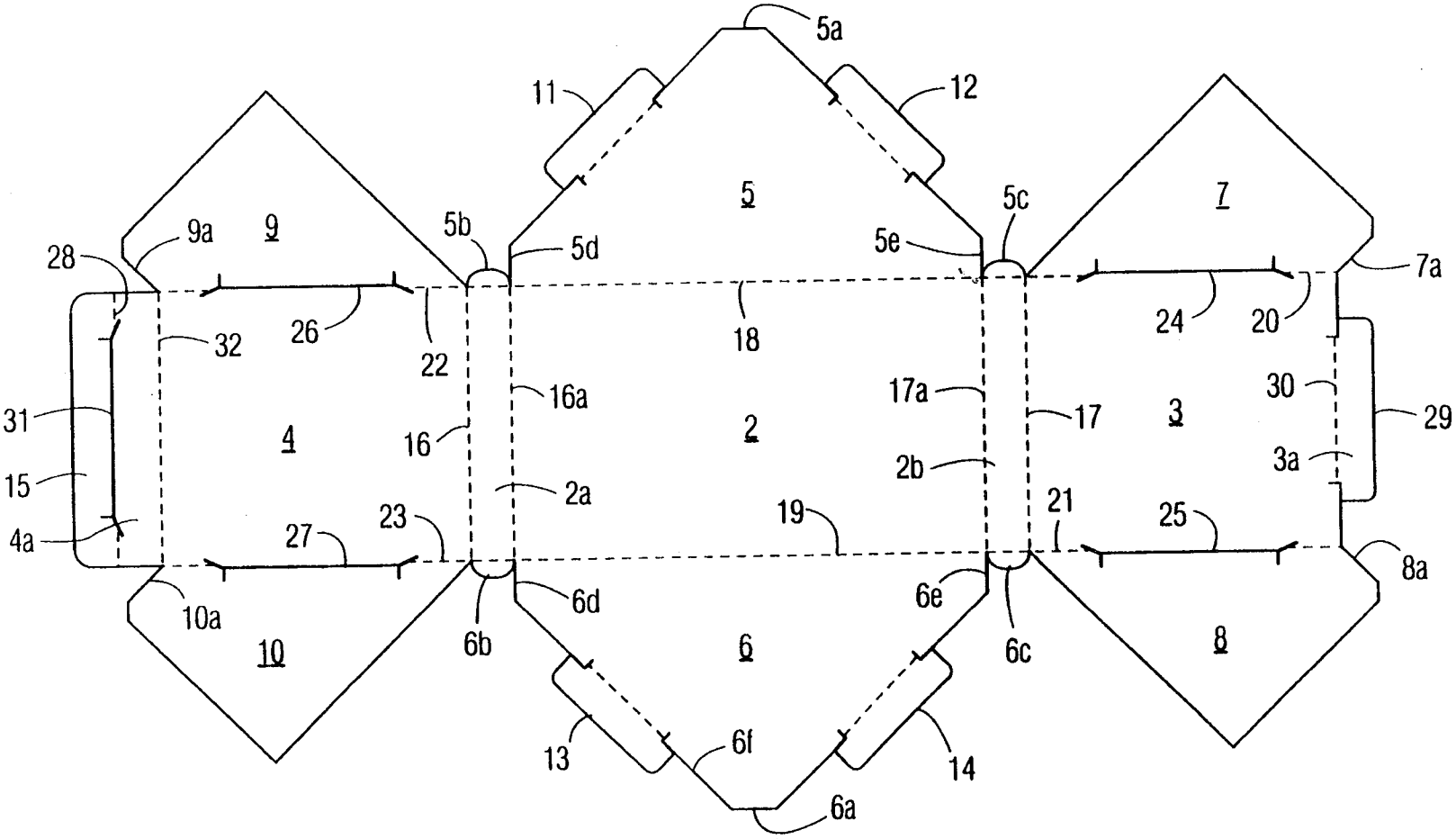
FIG. 6 shows a unitary blank for the carton of FIG. 5.

FIG. 2 shows a unitary blank generally denoted as 1 for the packed electric lamp of triangular configuration according to the invention. The blank 1 is preferably of a semi-rigid material such as paperboard which is readily foldable when scored. In FIGS. 2 and 6, solid lines represent edges and/or slots in the blank while the dashed lines represent fold lines. The blank includes first, second and third rectangular side panels 2,3 and 4, respectively. The second and third panels are articulated at parallel fold lines 16,17 at the opposing short sides of panel 2. First and second primary triangular flaps 5,6 are articulated from the first panel 2 at fold lines 18,19 which extend perpendicular to the fold lines 16,17 and which define the two long sides of rectangular panel 2. Secondary triangular flaps 7,8 and 9,10 are articulated from the panels 3,4 along respective opposing fold lines 20,21 and 22,23 which are aligned with the fold lines 18,19. The flaps 5,6 include locking tabs 11,12 and 13,14 which are insertable into respective slots 26,24 and 27,25 in the panels 3 and 4 at the fold lines 22,20 and 23,21. End tab 15 is joined to panel 4 at fold line 28. A locking tab 29 is articulated on panel 3 at fold line 30 and is insertable into the slot 31 which extends along the fold line 28. The primary flaps are dimensioned such that they close the opposing triangular openings formed when panel 3 is connected to panel 4.

For receiving a sealed-beam lamp, the carton is partially assembled by folding panels 3,4 towards each other about the fold lines 16,17, folding the tab 15 against the now inside surface of panel 3 adjacent the locking tab 29, and inserting the locking tab 29 into the slot 31. The three rectangular panels now form a cylindrical sleeve of triangular cross-section having opposing open ends at the fold lines 18,20,22 and 19,21,23. The secondary flaps 8,10 are then folded inwardly so that their edges 8a,10a are adjacent the fold line 19, the second primary panel 6 is folded against the flaps 8,10 and the locking tabs 13,14 are inserted into and locked in the slots 27,25. The carton now has a closed triangular bottom and three connected side walls into which the sealed-beam lamp may be placed. The carton is completed by folding the secondary flaps 7,9 inwardly and by folding the primary flap 5 down over these flaps and inserting the locking tabs 11,12 into their respective slots 24,26. Instead of using locking tabs to secure the panels together the various top and bottom flaps may be glued together, which would make assembly more readily automatable. However, it is preferable that at least one of the primary flaps 5,6 be closed with locking tabs instead of glue so that a customer may open the package to view the lamp.

Figure 3A:
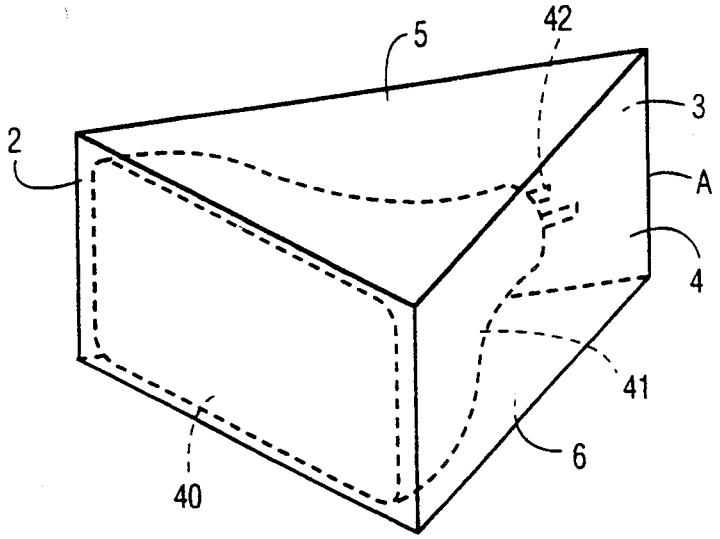
FIG. 3*a* is a perspective view of a packed sealed-beam lamp including the carton formed by the blank of FIG. 2.

FIG. 3*a* is a perspective view of the packed electric lamp according to the invention in which the sealed-beam lamp is enclosed in the carton formed by the unitary blank described above. The various secondary flaps and locking tabs are not shown for purposes of clarity. The broad face, or lens 40, of the lamp is positioned parallel to and adjacent the first rectangular panel 2. The lamp contacts 42 at the distal end of the tapered reflector body opposite the lens are positioned adjacent the corner "A" of the triangle formed by the second and third rectangular panels 3,4. The second and third panels 3,4 extend from the first panel 2 generally along the tapered body 41. Thus, the unitary blank of FIG. 2 forms a carton with three sides 2,3,4 defining a triangular cylinder whose ends are closed by opposing triangular sides 5,6.

Figure 1:
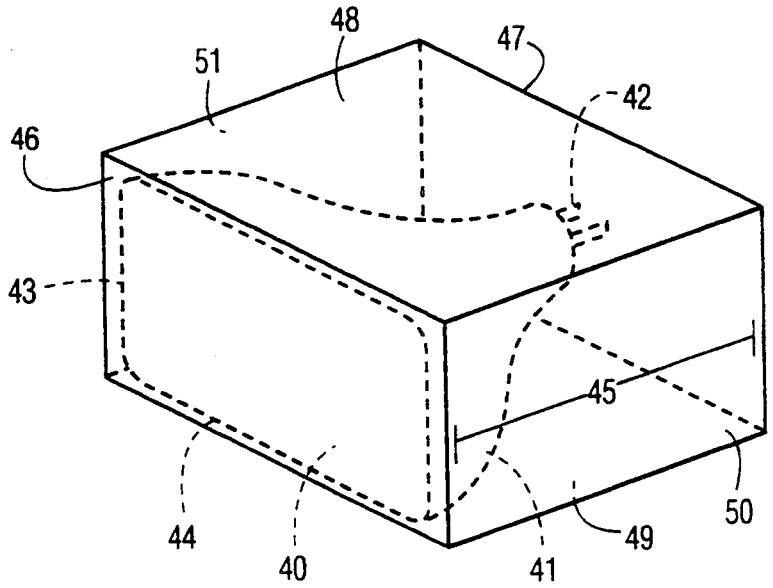
FIG. 1 PRIOR ART
FIG. 1 illustrates a packed sealed-beam automotive headlamp according to the prior art.
Figure 3B:
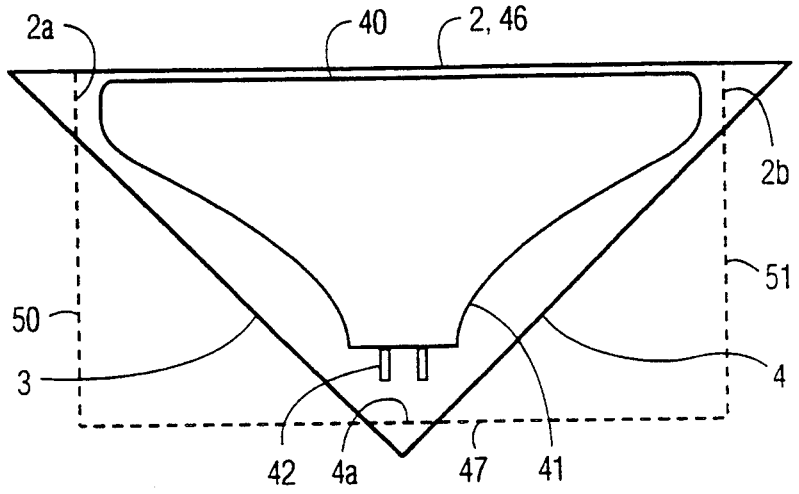
FIG. 3*b* is a top, plan view of the packed lamp shown in FIG. 3*a;*

The packed lamp would typically be arranged on a retail shelf with either of the sides 5,6 extending horizontally and parallel with the shelf. FIG. 3*b* shows the resulting planform in solid lines. The corresponding sides 46,47,50,51 of the prior art carton of FIG. 1 are shown in dashed lines for the sake of comparison. As is evident from FIG. 3*b*, the planform or area enclosed by the sides 2,3,4 is significantly less than the area enclosed by the sides 46,47,50,51 of the prior art rectangular carton. Additionally, FIG. 3*b* shows that the panels 2,3,4 form a right triangle, which facilitates a regular packing of the packed lamps in a shipping container.

Figure 4A:
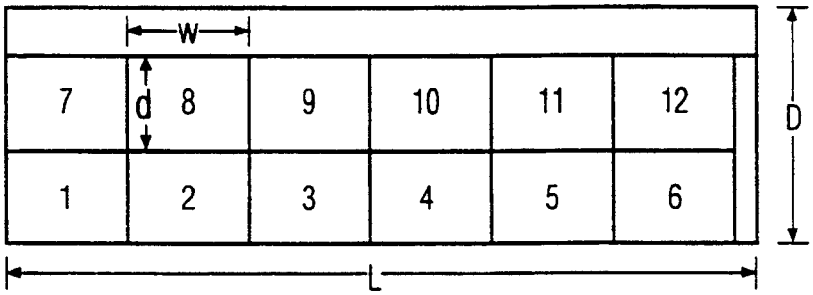
FIG. 4*a* illustrates the layout of the prior art packed lamp of FIG. 1 on a typical merchandising shelf.
Figure 4B:
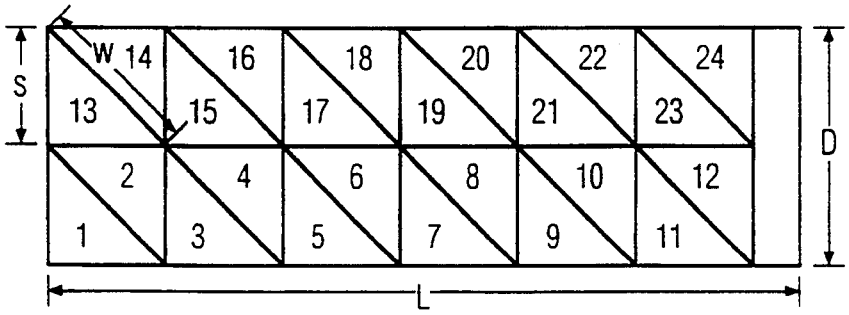
FIG. 4*b* illustrates the layout of the packed lamp according to FIGS. 3*a* on the same merchandising shelf.

The improvement in space utilization is illustrated in FIGS. 4*a*, 4*b* which are plan-o-grams of a rectangular and a triangular package, respectively, for an H6054 sealed beam lamp on a standard rectangular retail shelf having the a length dimension "L" of 48 inches and a depth dimension "D" of 15 inches. An H6054 sealed-beam headlamp has a rectangular lens face having a width dimension 44 of 7.7 in., a height dimension 43 of 5.6 in., and a depth dimension 45 from the lens face to the rear of the connection lugs of 5⅝ in. (see FIG. 1). As shown in FIG. 4, twelve (12) packed H4656 lamps of the prior art configuration would fit on this standard shelf. The conventional carton for the H6054 has a width "w" of 7¾ in., a depth "d" of 6 in. and a height of 5 11/16 in. For the same lamp, the triangular carton according to the invention has a dimension "w" along the lens face of 10 11/16 in. with the other two side panels having a dimension "s" of 7 ½ in. and a height of 5 11/16. The packed lamp in the triangular carton with these dimensions fits with 24 packed lamps on the shelf (FIG. 4*b*), twice as many as for the prior art carton. As another example, an H4656 lamp has a width dimension 44 of 6.5 in., a height dimension 43 of 4 ⅛ in., and a depth dimension 45 of 4.5 in. A representative prior art carton would have dimension "w" of 6 ⅝ in., a depth dimension "d" of 5 7/16 in., and a height dimension of 4 ⅛ in., of which fourteen (14) would fit on this standard shelf. By contrast, a packed H4656 lamp according to the invention having a height dimension of 4 ⅛ in., a dimension "w" along the lens face of 9 ¼ in. with the side panels 3,4 having a dimension "s" of 6 ½ in., would fit with thirty (30) packed lamps on the shelf.

Figure 5:
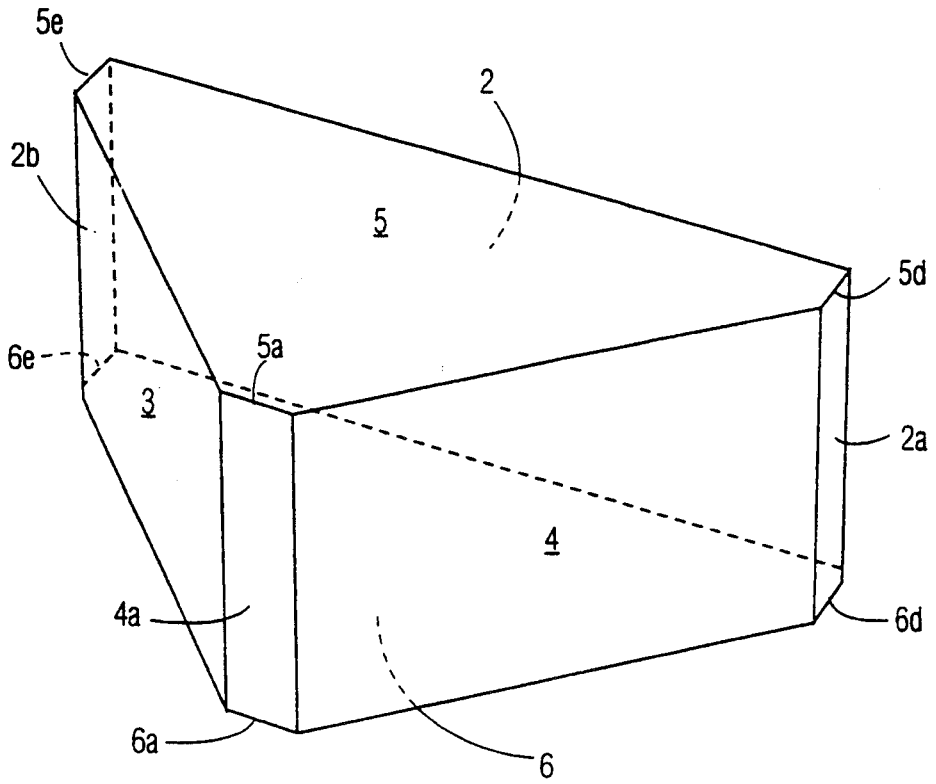
FIG. 5 is a perspective view of another embodiment of the invention in which the corners of the triangular carton are truncated.

FIG. 5 shows a packed lamp according to another embodiment of the invention in which each of the corners **5*a*,5*d*,5*e* and 6*a*,6*d*,6*e* of the opposing triangular sides 5,6 are truncated. Narrow panel portions 2*a*, 2*b* and 4*a*** extend between respective opposing pairs of the truncated corners. For purposes of clarity, the lamp and the secondary flaps and tabs are not illustrated. The planform of the carton of FIG. 5*a* is represented in FIG. 3*a* by the lines **2, 2*a*, 3, 4*a*, 4, and 2*b***. This further reduces packaging volume and planform over that illustrated in FIG. 3.

FIG. 6 shows a unitary blank for forming the carton shown in FIG. 5. The same reference numerals are used to identify parts which are similar to those shown in FIG. 2. In this embodiment, the panel 2 is truncated by forming additional fold lines **16*a*, 17*a* inward of and parallel to the fold lines 16,17, which creates narrow panel portions 2 *a,b* which extend between respective opposing truncated corners 5*e*,6*e* and 5*d*,6*d*. The apex of the triangular flaps 5,6 are truncated by forming edges 5*a*,6*a*. These edges may have any length, but in FIG. 6 are selected to be equal to the distance between the fold lines 16***a*, 17*a* for the sake of symmetry. The corners of the primary flaps 5,6 adjacent the fold lines 18,19 are truncated by forming edges 5 *d,e* and 6 *d,e* parallel to the respective fold lines 16*a*,17*a*. Flaps 5 *b,c* and 6 *b,c* articulate about the fold lines 18,19 respectively for supporting the primary flaps 5,6 in the closed condition of the carton. Fold line 32 is formed in the panel 4 and is separated from its adjacent fold line 16 by a distance equal to the length of edge 6*f*. The panel 4*a* has the same width as the edges 5*a*, 6*a* of the primary flaps. The carton is formed from the blank in essentially the same manner as described with respect to the blank of FIG. 2.

Those of ordinary skill in the art will appreciate that various modifications may be made to the above described embodiments which are within the scope of the appended claims. For example, in the embodiment of FIGS. 2,3 the secondary flaps 7–10 need not be triangular in shape but may have any shape and dimensions which ensure the functioning of the associated locking tabs and/or glue joints with the primary flaps 5,6. The primary flaps 5,6 need not articulate from the first, center panel 2 nor even from the same rectangular panel. The side panels need not be rectangular to keep the primary flaps perpendicular to the first panel and parallel to each other as in the above described embodiment. They may be trapezoidal, for example, so that the primary flaps taper towards each other in the direction of the apex "A". While this would further reduce the packed volume, it would adversely affect stackability. Furthermore, the number and arrangement of locking tabs may varied. Accordingly, the description is to be understood to be illustrative only and not limiting.

What we claim is:

1. A packed electric lamp, comprising:

a) an electric lamp having a broad face and a tapered body extending from said face and terminating at a distal end; and b) a carton for holding said lamp, said carton comprising three sides defining a sleeve of triangular cross-section with opposing open ends, two opposing triangular sides closing the open ends of the sleeve, and securing means for securing said carton in a closed manner about said electric lamp, said electric lamp being arranged in said carton between said opposing triangular sides with said broad face extending along one of said three sides defining said triangular sleeve, the other two of said three sides defining the triangular sleeve extending generally along said tapered body and terminating at a corner of said triangular sleeve adjacent said distal end of said tapered body.

2. A packed electric lamp according to claim 1, wherein said lamp is a sealed-beam reflector lamp in which said broad face is one of a rectangular lens and a circular lens and said tapered body comprises a reflector.

3. A packed electric lamp according to claim 1, wherein said carton is comprised by a unitary blank having three articulated panels for defining said triangular sleeve and two primary triangular flaps each articulated from one of said three panels for closing a respective open end of said triangular sleeve.

4. A packed electric lamp according to claim 3, wherein said securing means includes a said primary triangular flap having a locking tab for detachably securing it to said articulated panels.

5. A packed electric lamp according to claim 4, wherein said lamp is a sealed-beam reflector lamp in which the broad face is one of a rectangular lens and a circular lens and the tapered body comprises a reflector.

6. A packed electric lamp according to claim 3, wherein said sleeve is cylindrical and the shape of said triangular flaps and the cross-section of said cylindrical sleeve formed by said three articulated panels is defined by an isosceles right-triangle.

7. A packed electric lamp according to claim 1, wherein said sleeve is cylindrical and the shape of the opposing triangular sides and the cross-section of said cylindrical sleeve defined by said three sides is defined by an isosceles right-triangle.

8. A packed electric lamp according to claim 7, wherein said two opposing triangular sides are parallel to each other and normal to each of said three sides defining said triangular, cylindrical sleeve.

9. A packed electric lamp according to claim 1, wherein said two opposing triangular sides are parallel to each other and normal to each of said three sides defining said triangular, cylindrical sleeve.

10. A packed electric lamp according to claim 1, wherein said opposing triangular sides of said carton have a pair of opposing truncated corners, and said panels defining said triangular sleeve include a narrow portion extending between said truncated corners.

11. A packed electric lamp according to claim 10, wherein each of the three corners of both of said opposing triangular sides are truncated and said panels defining said triangular sleeve comprise three narrow portions each extending between a respective opposing pair of said truncated corners.

12. A packed electric lamp according to claim 11, wherein said lamp is a sealed-beam reflector lamp in which said broad face is one of a rectangular lens and a circular lens and said tapered body comprises a reflector.

13. A packed electric lamp according to claim 11, wherein said carton is comprised by a unitary blank having three articulated panels for defining said triangular sleeve and two opposing primary triangular flaps each articulated from respective ones of said three panels for closing the open ends of the triangular sleeve, each of the three corners of both triangular flaps being truncated and said three articulated panels including three narrow portions each for extending between respective pairs of the truncated flap corners.

* * * * *